US009912097B2

(12) United States Patent
Lee

(10) Patent No.: US 9,912,097 B2
(45) Date of Patent: Mar. 6, 2018

(54) CONNECTOR ASSEMBLY CAPABLE OF PREVENTING DAMAGE TO CABLE

(71) Applicant: Hyundai Motor Company, Seoul (KR)

(72) Inventor: Seung-Geun Lee, Gyeonggi-Do (KR)

(73) Assignee: Hyundai Motor Company, Seoul (KR)

( * ) Notice: Subject to any disclaimer, the term of this patent is extended or adjusted under 35 U.S.C. 154(b) by 221 days.

(21) Appl. No.: 14/520,816

(22) Filed: Oct. 22, 2014

(65) Prior Publication Data

US 2015/0180164 A1 Jun. 25, 2015

(30) Foreign Application Priority Data

Dec. 20, 2013 (KR) ..... 10-2013-0160108

(51) Int. Cl.

*H01R 13/74* (2006.01)
*H01R 13/52* (2006.01)
*H01R 13/56* (2006.01)
*H01R 13/627* (2006.01)

(52) U.S. Cl.

CPC ..... *H01R 13/562* (2013.01); *H01R 13/6273* (2013.01); *H01R 13/743* (2013.01); *H01R 13/52* (2013.01)

(58) Field of Classification Search

CPC .. H01R 13/74; H01R 13/743; H01R 13/6273; H01R 24/52; H01R 13/5825; H01R 13/5804; H01R 24/76; H01R 13/562; H01R 13/6271

USPC ..... 439/279, 282, 298, 352, 546, 550, 552, 439/555, 557, 562, 567, 32, 544; 174/380, 68.3, 95, 70 C, 72 R, 69, 70 R, 174/71 R, 68.1

See application file for complete search history.

(56) References Cited

U.S. PATENT DOCUMENTS 3,874,761 A * 4/1975 Stauffer ..... H01R 13/5221 439/279
4,043,630 A * 8/1977 Suverison ..... H01R 13/504 439/606
4,192,964 A 3/1980 Sacks
4,591,226 A * 5/1986 Hargett ..... E21B 17/028 439/192
6,206,712 B1 * 3/2001 Norizuki ..... H01R 13/6273 439/247
6,290,536 B1 * 9/2001 Hwang ..... H01R 13/631 439/378
6,406,192 B1 * 6/2002 Chen ..... H01R 13/6315 385/56

(Continued)

FOREIGN PATENT DOCUMENTS

EP 2 192 655 A2 6/2010
JP 09-245921 9/1997

(Continued)

*Primary Examiner* — Renee Luebke
*Assistant Examiner* — Paul Baillargeon
(74) *Attorney, Agent, or Firm* — Mintz Levin Cohn Ferris Glovsky and Popeo, P.C.; Peter F. Corless

(57) ABSTRACT

A connector assembly that prevents damage to a cable is provided. The connector assembly includes an inserting aperture that is disposed on one side of a housing of an electronic power element and a female connector that is connected to an embedded cable disposed within the housing and detachably mounted in the inserting aperture. Further, a male connector connects the embedded cable to an external cable when coupled with the female connector.

10 Claims, 3 Drawing Sheets

(56) References Cited

U.S. PATENT DOCUMENTS

| | | | | |
|---|---|---|---|---|
| 6,747,542 | B1 * | 6/2004 | Hoehn | F04D 29/584 338/220 |
| 6,880,877 | B2 * | 4/2005 | Sawayanagi | B60R 11/00 248/222.12 |
| 7,201,609 | B2 * | 4/2007 | Ishikawa | H01R 13/5219 439/157 |
| 7,677,499 | B2 * | 3/2010 | Weaver | B64D 15/12 174/69 |
| 8,187,026 | B2 * | 5/2012 | Tachiki | H01R 13/743 403/409.1 |
| 8,360,536 | B2 * | 1/2013 | Garg | H02G 3/0481 108/50.02 |
| 2005/0191891 | A1 * | 9/2005 | Khoury | H01R 13/625 439/357 |
| 2015/0155666 | A1 * | 6/2015 | Rosenblum | H01R 25/006 439/32 |

FOREIGN PATENT DOCUMENTS

| | | | |
|---|---|---|---|
| JP | 2000-195357 | A | 7/2000 |
| JP | 2004-185926 | A | 7/2004 |
| KR | 10-2005-0029703 | | 3/2005 |
| KR | 10-2005-0123461 | A | 12/2005 |
| KR | 1020100079595 | | 7/2010 |

* cited by examiner

CONNECTOR ASSEMBLY CAPABLE OF PREVENTING DAMAGE TO CABLE

CROSS-REFERENCE(S) TO RELATED APPLICATIONS

This application claims priority to Korean Patent Application No. 10-2013-0160108, filed on Dec. 20, 2013, which is incorporated herein by reference in its entirety.

BACKGROUND

Field of the Invention

The present invention relate to a connector assembly capable of preventing damage to a cable, and particularly, to a connector assembly which prevents a cable from being damaged through an external force applied to a cable connected to an electronic power element.

Description of Related Art

In recent years, numerous electric equipment/elements have been mounted to a motor vehicle to perform various functions. In hybrid and electric vehicles, in particular, a high-voltage cable is mounted to a modularized electronic power element. Currently the space available to the mounting part, to which the electronic power elements are mounted, is restricted. Accordingly, the electronic power elements are generally connected using a limited length high-voltage cable.

When a cable or a connector is damaged, a risk exists for a fire or an electrical shock caused by the high-voltage current, and the element may not meet necessary safety laws and regulations. However, when an external force is applied to the electronic power elements, such as during a collision between vehicles, the cable may be cut by the force applied to the cable having such a limited length during the collision.

SUMMARY

An objective of the present invention provides a connector assembly which prevents a cable and a connector from being damaged, even when a gap between electronic power elements is widened and a longer high-voltage cable is used, when a vehicle collides with another vehicle.

In order to achieve the above objective, the present invention provides a connector assembly preventing damage to a cable that may include an inserting aperture disposed on one side of a housing of an electronic power element, a female connector connected to an embedded cable disposed within the housing, the female connector being detachably mounted in the inserting aperture and a male connector coupled with the female connector to connect the embedded cable to an external cable.

In accordance with one aspect of the present invention, a surplus portion of the embedded cable may be embedded in the housing, the female connector may include a protective tube to allow a portion of the embedded cable to be surrounded with the protective tube, the protective tube may have ring-shaped corrugations formed continuously thereon in a longitudinal direction, the protective tube may be an elastic member which may be extended in the longitudinal direction, and the protective tube may include a plurality of pipes which are coaxially disposed and have diameters that differ from each other.

According to another aspect of the present invention, the female connector may include a female terminal part coupled with a male terminal part within the male connector, a body part having a predetermined thickness and surrounding an outer circumference of the female terminal part; a tubular mounting part being coaxially disposed around the body part and having two longitudinal ends, which may not be in contact with the body part; and a protective tube of a prescribed length surrounding a portion of an embedded cable and attached to a longitudinal one side of the female terminal part.

According to another aspect of the present invention, the inserting hole may have a substantially triangular-shaped first protrusion formed on an inner surface thereof and protruding toward a female connector, the first protrusion may be formed at two points on an inner surface of the inserting aperture, where the two points face each other.

Additionally, the first protrusion may be formed continuously along an inner surface of the inserting aperture. A mounting part disposed on a female connector may have a substantially triangular-shaped second protrusion formed on an outer surface thereof and protruding toward an inner surface of the inserting aperture. The second protrusion may be formed such that an inclined side thereof may be in contact with an inclined side of the first protrusion, and the second protrusion may be formed on two points on an outer surface of the mounting part, where the two points face each other. In addition, the male connector may have hook parts facing each other and formed outward on both side surfaces thereof, and the female connector may have hook-shaped protrusions facing each other and formed on an inner surface of the mounting part provided thereon, each of the hook-shaped protrusions may be engaged with the hook parts of the male connector.

BRIEF DESCRIPTION OF THE DRAWINGS

The above and other features of the present invention will now be described in detail with reference to certain exemplary embodiments thereof illustrated in the accompanying drawings which are given herein below by way of illustration only, and thus are not limitative of the present invention, and wherein.

DETAILED DESCRIPTION

Figure 1:
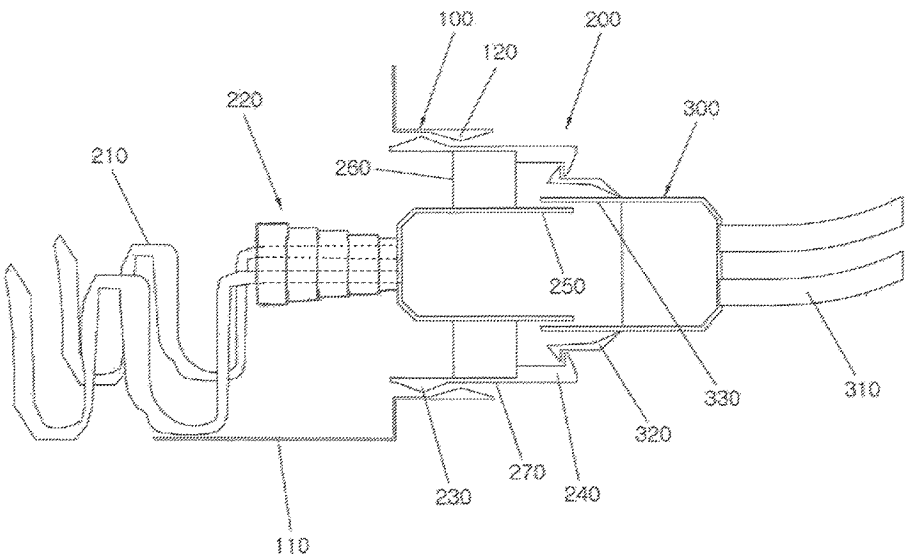
FIG. 1 is an exemplary cross-sectional view of a part of a connector assembly preventing damage to a cable, according to one exemplary embodiment of the present invention.

Exemplary embodiments of the present invention will be described below in more detail with reference to the accompanying drawings. The present invention may, however, be embodied in different forms and should not be construed as limited to the exemplary embodiments set forth herein. Rather, these exemplary embodiments are provided so that this disclosure will be thorough and complete, and will fully convey the scope of the present invention to those skilled in the art. Throughout the disclosure, like reference numerals refer to like parts throughout the various figures and exemplary embodiments of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Figure 2:
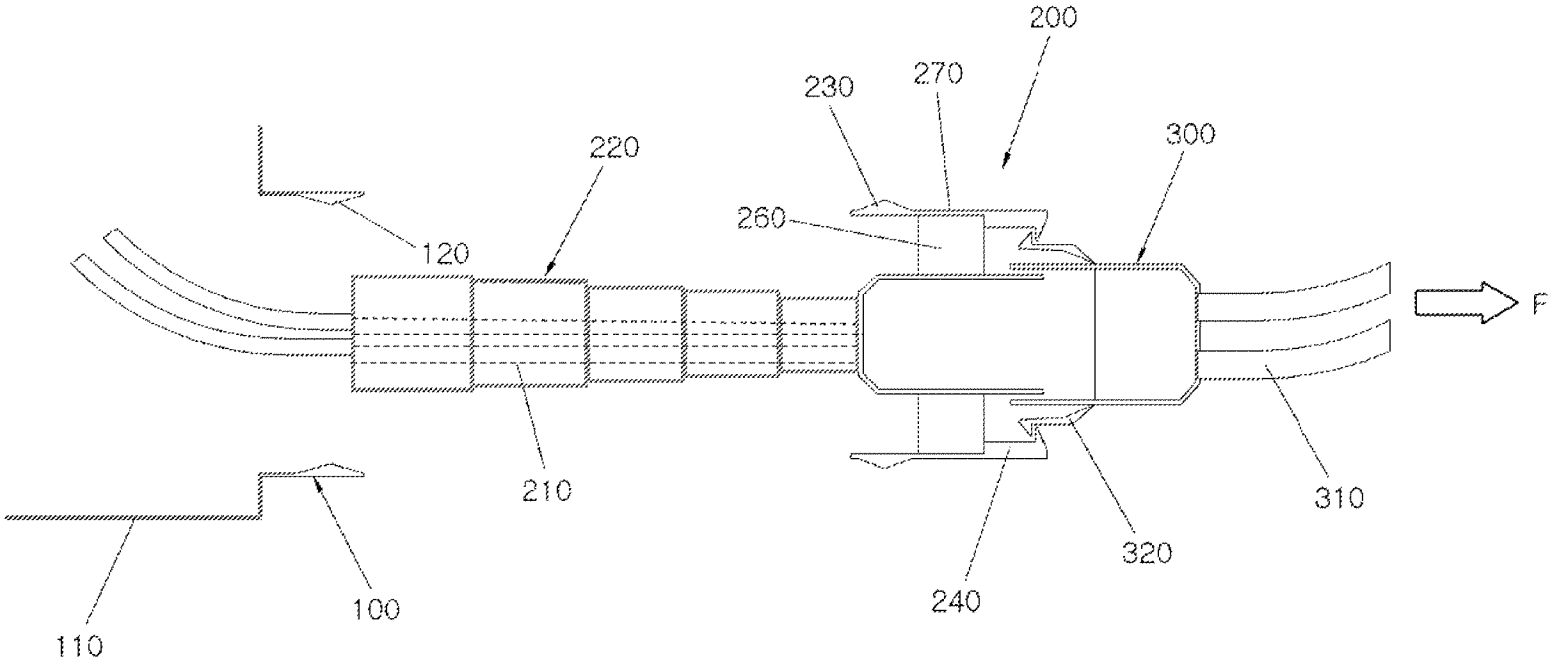
FIG. 2 is an exemplary cross-sectional view of another part of a connector assembly preventing damage to a cable, shown in FIG. 1 according to an exemplary embodiment of the present invention.
Figure 3:
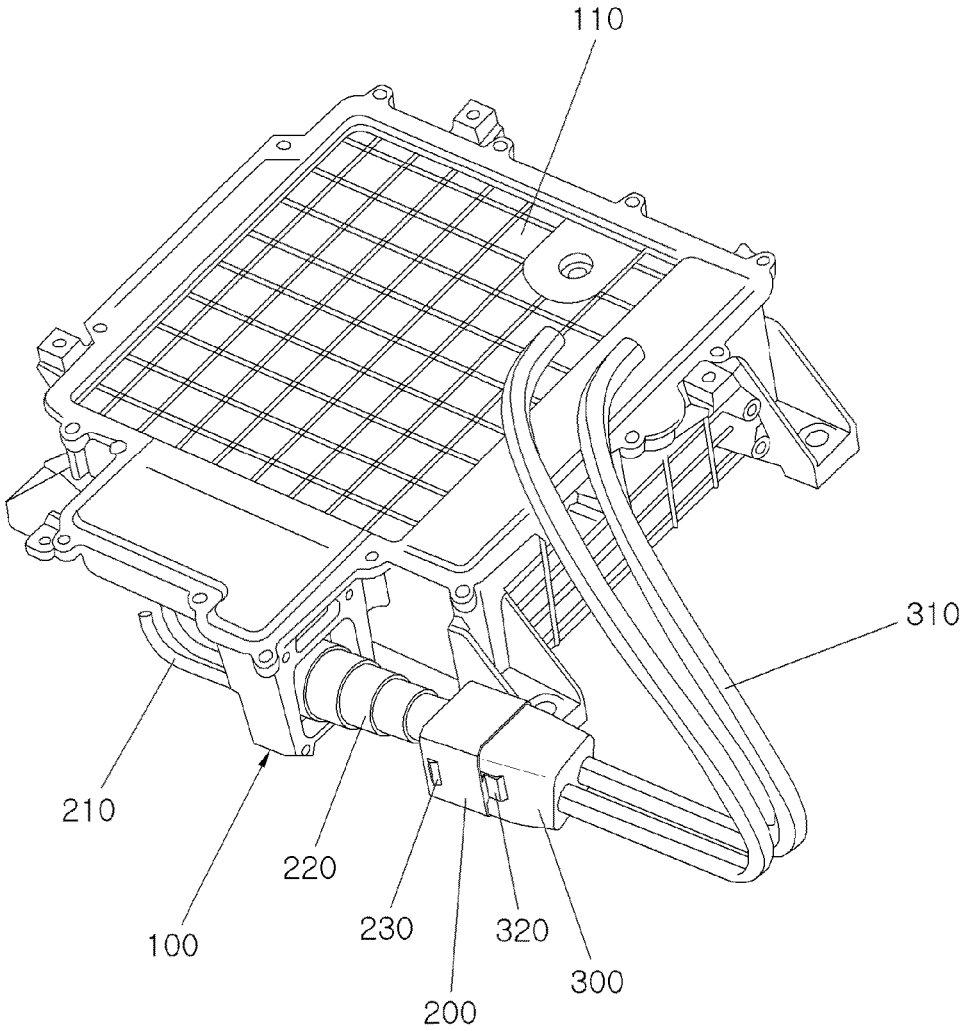
FIG. 3 is an exemplary perspective view showing an exemplary state in which a connector assembly is preventing damage to a cable, shown in FIG. 1 according to an exemplary embodiment of the present invention, is installed.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles. FIG. 1 is an exemplary cross-sectional view of a part of a connector assembly preventing damage to a cable, in accordance with one exemplary embodiment of the present invention. FIG. 2 is an exemplary cross-sectional view of another part of a connector assembly preventing damage to a cable, shown in FIG. 1. FIG. 3 is an exemplary perspective view showing a state in which a connector assembly preventing damage to a cable, shown in FIG. 1, is installed.

As shown in FIGS. 1 to 3, a connector assembly preventing damage to a cable in accordance with the present invention may include an inserting aperture 100 formed on one side (e.g., a first side) of a housing 110 of an electronic power element, a female connector 200 connected to an embedded cable 210 disposed within the housing 110 and detachably mounted in the inserting aperture 100 and a male connector 300 coupled with the female connector 200 to connect the embedded cable 210 to an external cable 310.

In addition, a surplus portion of the embedded cable 210 may be embedded in the housing 110 and a protective tube 220 may be disposed in the female connector 200 to allow a portion of the embedded cable 210 to be surrounded with the protective tube. The surplus portion of the embedded cable 210 may be embedded in the housing 110 and the female connector 200 may include a female terminal part 250 coupled with a male terminal part 330 within the male connector 300, a body part 260 having a predetermined thickness and surrounding an outer circumference of the female terminal part 250, and a tubular mounting part 270 coaxially disposed around the body part 260 and having longitudinal ends spaced from the body part 260. The protective tube 220 surrounding a portion of the embedded cable 210 is attached to a longitudinal side of the female terminal part 250.

The protective tube 220 may be configured to prevent damage to the embedded cable 210 caused by contact between the embedded cable 210 and a surrounding object when the embedded cable 210 is drawn outside of the housing 110. Further, the protective tube may have a predetermined volume and is received in the housing 110.

In one exemplary embodiment of the present invention, the protective tube 220 may have ring-shaped corrugations formed continuously thereon in the longitudinal direction. Due to the corrugations, the protective tube 220 may be compressed toward the female connector 200 to minimize a volume of the protective tube. An elastic member may be used as a protective tube 220, which may be extended in a longitudinal direction. Besides the elastic member, a plurality of pipes disposed and have diameters that differ from each other may also be employed as the protective tube 220.

When the pipe having a smaller diameter is inserted in the pipe having a greater diameter, an entire volume of the pipes may be minimized and the plurality of pipes may be received within the housing 110. When the embedded cable 210 is drawn outside of the housing 110, the plurality of pipes may connect to each other in the longitudinal direction to increase an entire length of the pipes and enable the embedded cable 210 placed in the pipes to be protected from an external object.

Further, a substantially triangular-shaped first protrusion 120 protruded toward the female connector 250 may be formed on an inner surface of the inserting aperture 100. In one exemplary embodiment of the present invention, the first protrusion 120 may be formed on two points of an inner surface of the inserting aperture 100, where the two points face each other. A plurality of first protrusions 120 may be continuously formed along an inner surface of the inserting aperture 100.

Further, a substantially triangular-shaped second protrusion 230 protruded toward an inner surface of the inserting aperture 100 may be formed on an outer surface of the mounting part 270 provided on the female connector 250. An inclined side of the second protrusion may be in contact with an inclined side of the first protrusion 120. In one exemplary embodiment of the present invention, the second protrusion 230 may be formed on two points of an outer surface of the mounting part 270, where the two points face each other.

Since the first protrusion 120 and the second protrusion 230 may be substantially triangularly-shaped, when an external force exceeding a predetermined value is applied to the female connector 200 in the lengthwise direction, the second protrusion 230, that is the mounting part 270, may be elastically deformed to detach the first protrusion 120 from the second protrusion 230 without causing damage. Accordingly, a surplus portion of the embedded cable 210, contained within the housing 110, may be drawn out of the housing 110 through the inserting aperture 100 by the female connector 200, detached from the inserting aperture 100, to prevent damage to the embedded cable 210 by an external force (see FIG. 2).

Additionally, a plurality of hook parts 320 facing each other may be formed outward on both side surfaces of the male connector 300. Two hook-shaped protrusions 240 facing each other may be formed on an inner surface of the mounting part 270 disposed on the female connector 200. Each of the hook-shaped protrusions 240 may be engaged with the hook parts 320. A coupling protrusion may be formed on an outer surface of the male connector 300 and the hook part 320 may be formed on the coupling protrusion to provide elasticity to the hook part. When the hook part 320 is engaged with the hook-shaped protrusion 240, the male connector 300 may not detach from the female connector 200 when an external force is applied.

As shown in FIG. 3, the connector assembly, which prevents a cable from being damaged in accordance with the present invention, may be installed on a housing of a conventional electronic power element without significant modification.

According to the present invention, when a gap between the electronic power elements is widened and a high-voltage cable is drawn out during a vehicle collision, the female connector 200 may be separated from the inserting aperture 100 and a surplus portion of the embedded cable 210 embedded within the housing may be simultaneously drawn out of the housing to prevent damage to the cable.

In addition, the present invention is advantageous in that since the female connector 200 may be detached from the inserting aperture 100, damage to the female connector 200 may be prevented. Furthermore, since a surplus portion of the embedded cable may be protected by the protective tube, it may be possible to prevent damage to the embedded cable caused by a secondary impact. In addition, the present invention allows surplus portion of the embedded cable to be disposed within the housing so that the amount of mounting space is less limited.

Furthermore, it may be possible to meet relevant laws/regulations for fire prevention and electrical shock prevention caused when a hybrid electric vehicle is involved in a collision using the structure of the present invention.

While the present invention has been described with respect to the exemplary embodiments, it will be apparent to those skilled in the art that various changes and modifications may be made without departing from the spirit and scope of the invention as defined in the following claims.

What is claimed is:

1. A connector assembly that prevents damage to a cable, comprising:

an inserting aperture disposed on one side of a housing of an electronic power element; and a female connector detachably mounted within the inserting aperture and connected to an embedded cable disposed within the housing, wherein the female connector includes a protective tube to allow a portion of the embedded cable to be surrounded with the protective tube, and wherein the protective tube includes:

a plurality of pipes coaxially disposed and having diameters that differ from each other, such that a first pipe of smaller diameter is inserted in a second pipe of greater diameter, the plurality of pipes configured to be received in the housing, and the plurality of pipes being connected to each other in a telescoping arrangement in a longitudinal direction such that an overall length of the plurality of pipes increases to protect the embedded cable when the embedded cable is drawn outside the housing.

2. The connector assembly of claim 1, wherein a surplus portion of the embedded cable is embedded within the housing.

3. The connector assembly of claim 1, wherein the female connector includes:

a female terminal part, coupled with a male terminal part disposed in a male connector, coupled with the female connector to connect the embedded cable to an external cable;

a body part having a predetermined thickness and surrounding an outer circumference of the female terminal part;

a tubular mounting part coaxially disposed around the body part and having longitudinal ends, spaced apart from the body part; and the protective tube surrounding a portion of the embedded cable and attached to a longitudinal side of the female terminal part.

4. The connector assembly of claim 1, wherein the inserting aperture includes a triangular-shaped first protrusion formed on an inner surface thereof and protruding toward the female connector.

5. The connector assembly of claim 4, wherein the first protrusion is formed on two points of an inner surface of the inserting aperture, which face each other.

6. The connector assembly of claim 4, wherein the first protrusion is continuously formed along an inner surface of the inserting aperture.

7. The connector assembly of claim 4, wherein a mounting part disposed on the female connector includes a triangular-shaped second protrusion formed on an outer surface thereof and protruding toward an inner surface of the inserting aperture, the second protrusion being formed with an inclined side thereof in contact with an inclined side of the first protrusion.

8. The connector assembly of claim 7, wherein the second protrusion is formed on two points of the outer surface of the mounting part, which face each other.

9. The connector assembly of claim 1, further comprising:

a male connector that includes a plurality of hook parts facing each other and formed outward on both side surfaces of the male connector and may be coupled with the female connector.

10. The connector assembly of claim 9, wherein the female connector includes hook-shaped protrusions facing each other and formed on an inner surface of a mounting part disposed thereon and engaged with the hook parts of the male connector.

* * * * *